US005279263A

United States Patent [19]

Cameau et al.

[11] Patent Number: 5,279,263

[45] Date of Patent: Jan. 18, 1994

[54] CASCADED STEAM TEMPERATURE CONTROL APPLIED TO A UNIVERSAL PRESSURE BOILER

[75] Inventors: Max-Alix Cameau, Cleveland Heights; Alfred Schultz, Mentor, both of Ohio; Lemuel E. Dolan, Lawrenceville, Ga.

[73] Assignee: Elsag International B.V., Amsterdam Zuidoost, Netherlands

[21] Appl. No.: 14,127

[22] Filed: Feb. 5, 1993

[51] Int. Cl.[5] ..... F22G 5/04

[52] U.S. Cl. ..... 122/480; 122/448.1; 122/460; 364/550; 236/14

[58] Field of Search ..... 122/448.1, 459, 460, 122/480; 364/550; 236/14

[56] References Cited

U.S. PATENT DOCUMENTS 4,787,554 11/1988 Bartels et al. ..... 122/448.1 X
4,841,918 6/1989 Fukayama et al. ..... 122/448.1 X
5,053,978 10/1991 Solomon ..... 364/550

*Primary Examiner*—Edward G. Favors
*Attorney, Agent, or Firm*—Michael M. Rickin; Vytas R. Matas

[57] ABSTRACT

The firing rate and the feedwater flow rate of a universal pressure boiler are controlled using a cascaded steam temperature control system. The secondary superheater outlet temperature comprises an outer loop for the control system, while the convection pass outlet temperature comprises an inner loop for the control system. Control variables for the system include the secondary superheater outlet temperature, the convection pass outlet temperature and the difference between the primary superheater outlet temperature and the secondary superheater inlet temperature.

4 Claims, 4 Drawing Sheets

FW FLW
FF FLW
FF-FW
FW/FR
NO CORRECTION
FST

| | UNIT LOAD DEMAND (MW) | FWT (DEG F) | CPOT (DEG F) | PSHOT (DEG F) | SSHIT (DEG F) | SSHOT (DEG F) |
|---|---|---|---|---|---|---|
| | 114.4 | 367 | 749.6 | 834.1 | 623.2 | 996.3 |
| | 159 | 393.9 | 754.8 | 829.6 | 650.7 | 1000 |
| | 170 | 399.4 | 752.6 | 824.1 | 650.8 | 999 |
| | 176.6 | 401.7 | 751.5 | 822 | 652.1 | 999.3 |
| | 180.6 | 403.8 | 750.2 | 821.3 | 654.8 | 1000 |
| | 192.3 | 408.9 | 747 | 816.6 | 658.6 | 998.3 |
| | 208.2 | 415.3 | 745 | 812.7 | 666 | 999.6 |
| | 259.2 | 434.5 | 740 | 803.7 | 692.8 | 999.3 |
| | 310.9 | 450.9 | 738.1 | 799.8 | 719.4 | 998.9 |
| | 360.9 | 464.9 | 737 | 794.6 | 743.8 | 999.8 |
| AVERAGE TEMP | | 414.03 | 746.6 | 815.85 | 671.22 | 997.95 |
| MAXIMUM TEMP | | 464.9 | 754.8 | 834.1 | 743.8 | 1000 |
| MINIMUM TEMP | | 367 | 737.2 | 794.6 | 623.2 | 986.3 |
Fig.6
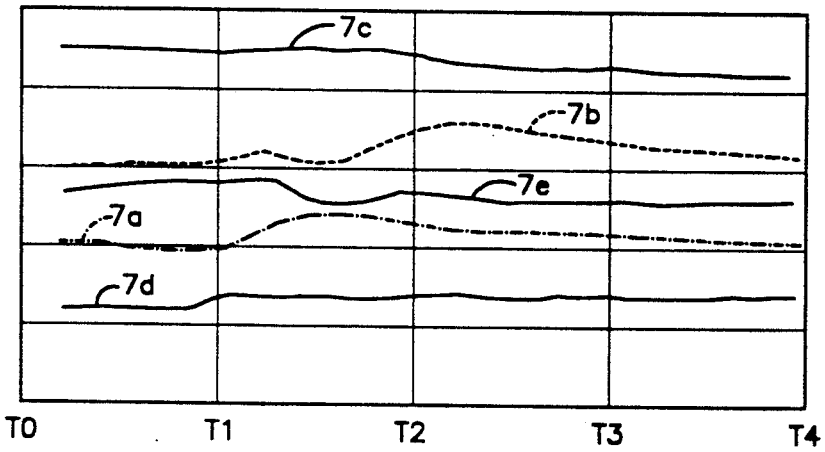
Fig.7
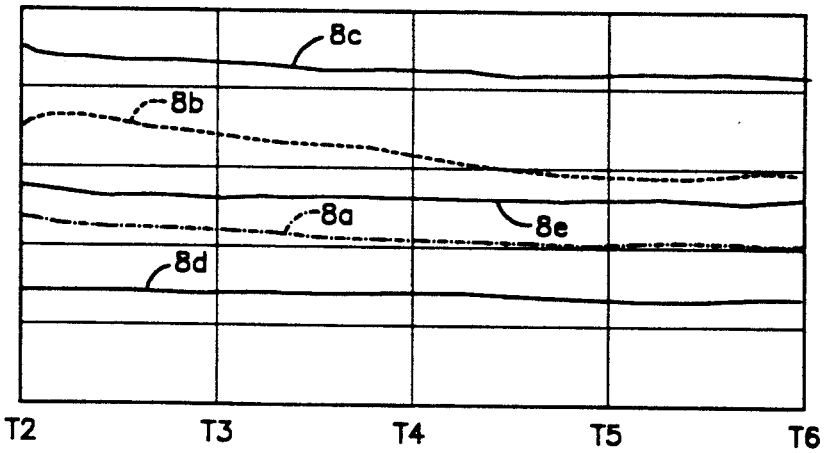
Fig.8

CASCADED STEAM TEMPERATURE CONTROL APPLIED TO A UNIVERSAL PRESSURE BOILER

FIELD AND BACKGROUND OF THE INVENTION

The present invention relates in general to control systems and in particular to a new and useful cascaded control system for a universal pressure boiler.

A known method of steam temperature control for universal pressure boilers, as illustrated in FIG. 1, utilizes a furnace gas temperature (FGT) 2, a primary superheater outlet temperature (PSHOT) 3, and a secondary superheater outlet temperature (SSHOT) 4 as primary controlled variables. This known control scheme utilizes a feedforward program based on a feedwater temperature error (FWTE) 22, a secondary superheater inlet temperature (SSHIT) 23, a secondary superheater outlet temperature error (SSHOTE) (not shown) and a primary super heater outlet temperature error (PSHOTE) 21.

The known steam temperature control system illustrated in FIG. 1 is devised to maintain a secondary superheater outlet temperature at a set point in order to account for transient disturbances within the universal pressure boiler. Currently, the conventional control system for the universal pressure boiler utilizes the furnace gas temperature transmitter 2, the secondary superheater outlet temperature transmitter 3 and a primary superheater outlet temperature transmitter 4 as the primary controlled variables. Unit load demand 20 is input into a function generator 10 having a maximum gas temperature. A difference unit 12 performs a subtracting action of the furnace gas temperature 2 and the set program of furnace which is in function generator 10 gas temperature and provides this difference to a low select auctioneer 13 for taking the lower value of the two.

Unit load demand 20 is input into a second function generator 110 for controlling the set program of secondary superheater outlet temperature. A second difference unit 112 performs a subtraction action on the secondary superheater outlet temperature 3 and the unit load demand 20 from the set program of the secondary superheater outlet temperature function generator 110. This difference is provided to a high select auctioneer 14 for taking the higher value of the two. Unit load demand 20 is input to a third function generator 210 for providing the desired primary superheater outlet temperature. This difference or primary superheater outlet temperature error 21 is provided to the high select auctioneer 14. The primary superheater outlet temperature error 21 is also provided to the low select auctioneer 13 in conjunction with the difference from the first difference unit 12.

The low select auctioneer 13 provides the lower value i.e. the difference from the difference unit 12 or the primary superheater outlet temperature error 21, to a derivative action unit 15. The lower value from the low select auctioneer 13 is also provided to a summer 17 and a transfer action unit 16. Derivative action unit 15 performs a rate function upon the value from the low select auctioneer 13. This rate provided by the derivative action unit 15 is summed along with the value from the low select auctioneer 13 by the summer 17. After a summing action is performed by the summer 17, this value is provided to a second summer 117.

The high select auctioneer 14 takes the greater value from either the primary superheater outlet temperature error 21 or the value provided by the second difference unit 112. The greater value is provided by the high select auctioneer 14 to the transfer action unit 16. The value from the high select auctioneer 14 is also provided to a second derivative action unit 115 for performing a rate function which is in turn provided to the second summer 117.

The transfer action unit 16 performs a transfer action of the value from the low select auctioneer 13 and the high select auctioneer 14 which constitutes a low load or bypass selection and once-through operation. Transfer action unit 16 transfers these values to an integral action control unit 18 which performs an integral function on these values and provides the result to the second summer 117.

Second summer 117 performs a summing action on values from the second derivative action unit 115, the integral action control unit 18, the first summer 17, a feedwater temperature error 22 and a secondary superheater inlet temperature 23 supplied through a third derivative action unit to 215.

After performing the summing action at the second summer 117, this value is provided to a multiplier 19 for performing a multiplying action. The unit load demand 20 is provided through a fourth function generator 310 to the multiplier 19 for multiplication with the value from the second summer 117.

The value from the multiplier 19 is provided to an inverse proportional action unit 11 and a fourth summer 317. Fuel flow demand 24 is also provided to the third summer 217 which in turn performs a summing action on the loss from the proportional action unit 11 and the fuel flow demand 24 for determining a firing rate 30 for the universal pressure boiler.

The fourth summer 317 takes the value from the multiplier 19 along with a feed water flow demand 25 for performing a summing action. Due to the summing action performed on these Values, a feedwater flow rate 31 for the universal pressure boiler is determined.

The conventional steam temperature control strategy, as described above, is divided into main regions: a low load or bypass region and an operating or high load region. In the low load region, which is generally the low range before a transfer is conducted from a flash tank operation or drum boiler type to a once-through operation, the furnace gas temperature 2 is used as the controlled variable. The set point is the load base 20 which is characterized for temperature. In the low load region, the primary superheater outlet temperature error 21 is used as an overriding signal for the furnace gas temperature error when the maximum temperature operating limit is reached near the minimum feedwater flow load. The overriding circuit of the conventional control system also provides protection for the superheater tubes.

The operating or high load region of the universal pressure boiler covers the load point range from a once-through operation to a full load operation. In the high-load region, it is necessary to use the primary superheater outlet temperature 4 and/or the secondary superheater outlet temperature 3 as the controlled variables. At this stage, temperature probes used in conjunction with the universal pressure boiler are retracted in order to render the furnace gas temperature control 3 as a non-factor.

The set point for the high load region is generated as a function of load characterized as steam temperature. A secondary superheater outlet temperature error is created by comparing the secondary superheater outlet temperature 3 to the programmed set point. This error is limited by the primary superheater outlet temperature error 21 which acts as an override circuit and a protector for the superheaters in case of extreme temperature excursions.

During a high load range, this scheme provides for transient conditions by using transient factors. One such transient factor is the feedwater temperature error 22 wherein an increase of this error implies a reduction in the superheater temperature because for any given steam flow, less fuel is fired into the boiler and less gas passes over the superheaters.

Another transient factor is a secondary super-heater inlet temperature kicker which is a signal used for adjusting the feedwater to fuel ratio which is caused by a change in the operating condition reflected at the secondary superheater inlet temperature 23 before the secondary superheater outlet temperature 3. Another transient factor is the secondary superheater outlet temperature error wherein its rate of change is indexed as a function of load and is used to correct the feedwater rate and firing rate.

There are several problems involved with employing the conventional steam temperature control as described above. First there is instability within the boiler at low load operations when controlled by the furnace gas temperature variable 2. Second, there is a lack of control and unaccountability for the tremendous dead time that exists at low loads due to the high heat absorption. Third, there is limited adaptive control capability for the system since the system controls only the final element i.e. the secondary superheater outlet temperature 3. Fourth, there is a slow or sluggish response in the operating range and overcompensation or undercompensation can occur due to the numerous kickers that are used as anticipatory signals. Fifth, the secondary superheater outlet temperature 3 is used as a kicker but in reality this signal is a feed-back and if not used with moderation, can create a continuous cycling problem for the system.

SUMMARY OF THE INVENTION

The present invention provides for a cascaded steam temperature control for a universal pressure boiler. The combination of signals used by the system of the present invention to provide temperature control are the secondary superheater outlet temperature, the convection pass outlet temperature, and the difference of the primary superheater outlet temperature with the secondary superheater inlet temperature. The control system of the present invention utilizes the secondary superheater outlet temperature, convection pass outlet temperature, primary superheater outlet temperature and secondary superheater inlet temperature as the controlled variables. With a change in temperature the secondary superheater outlet temperature will move slower than the convection pass outlet temperature. The present invention uses the sensitivity of the convection pass outlet temperature to predict the direction and amount of change in the secondary superheater outlet temperature.

It is an object of the present invention to provide a steam temperature control system for a universal pressure boiler that is more efficient and cost effective than the conventional control systems.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

FIG. 6 is a table illustrating the temperature profile for the controlled variables according to the present invention.

FIG. 7 are graphs illustrating the controlled variables with time.

FIG. 8 are continuations of the graphs shown in FIG. 7.

DESCRIPTION OF THE PREFERRED EMBODIMENT

Figure 1:
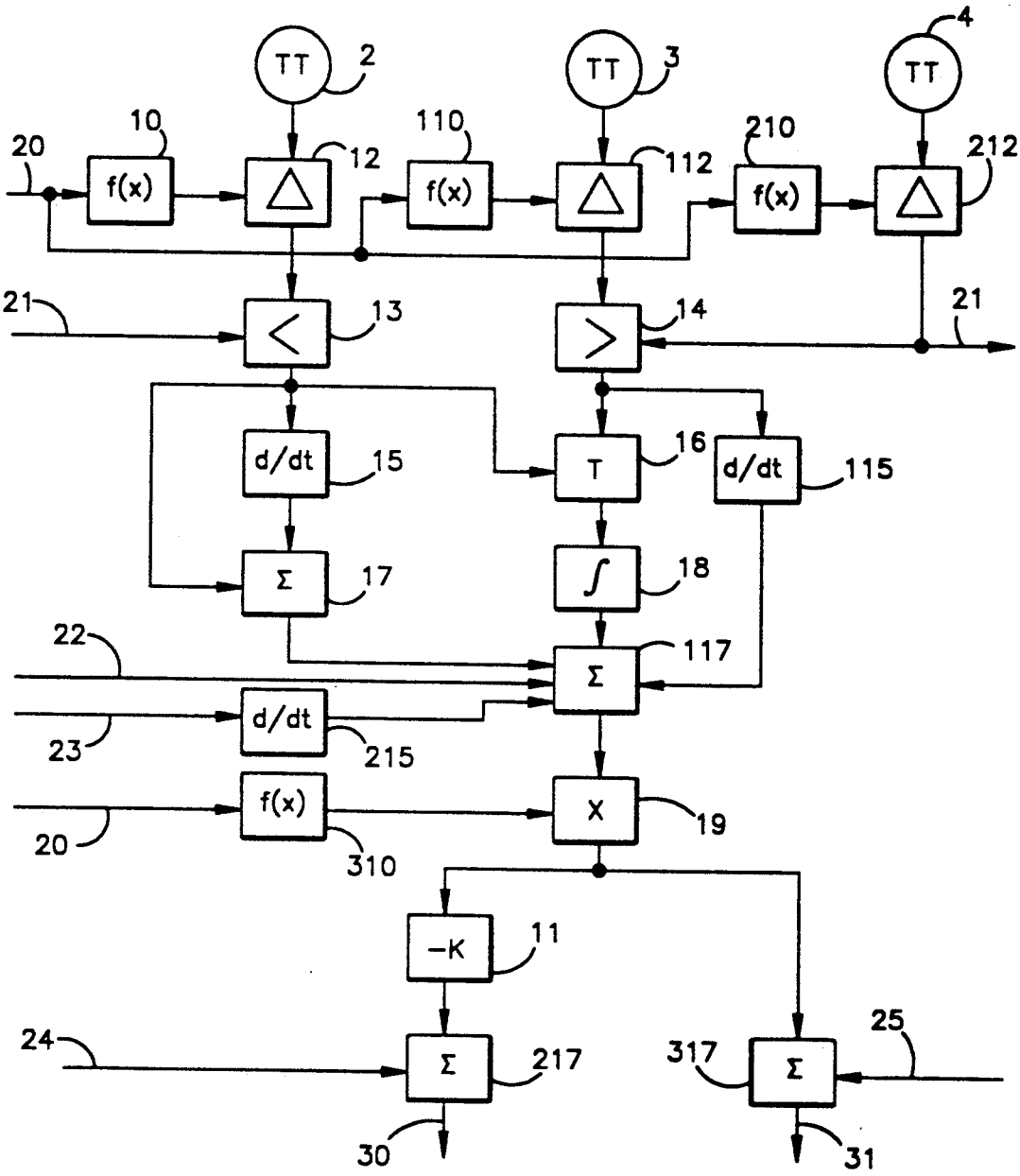
Fig.1 PRIOR ART
FIG. 1 is a schematic diagram of a known control system for a universal pressure boiler.

For the present invention, the same reference numerals are used to designate similar elements utilized by known control systems for a universal pressure boiler.

Figure 2:
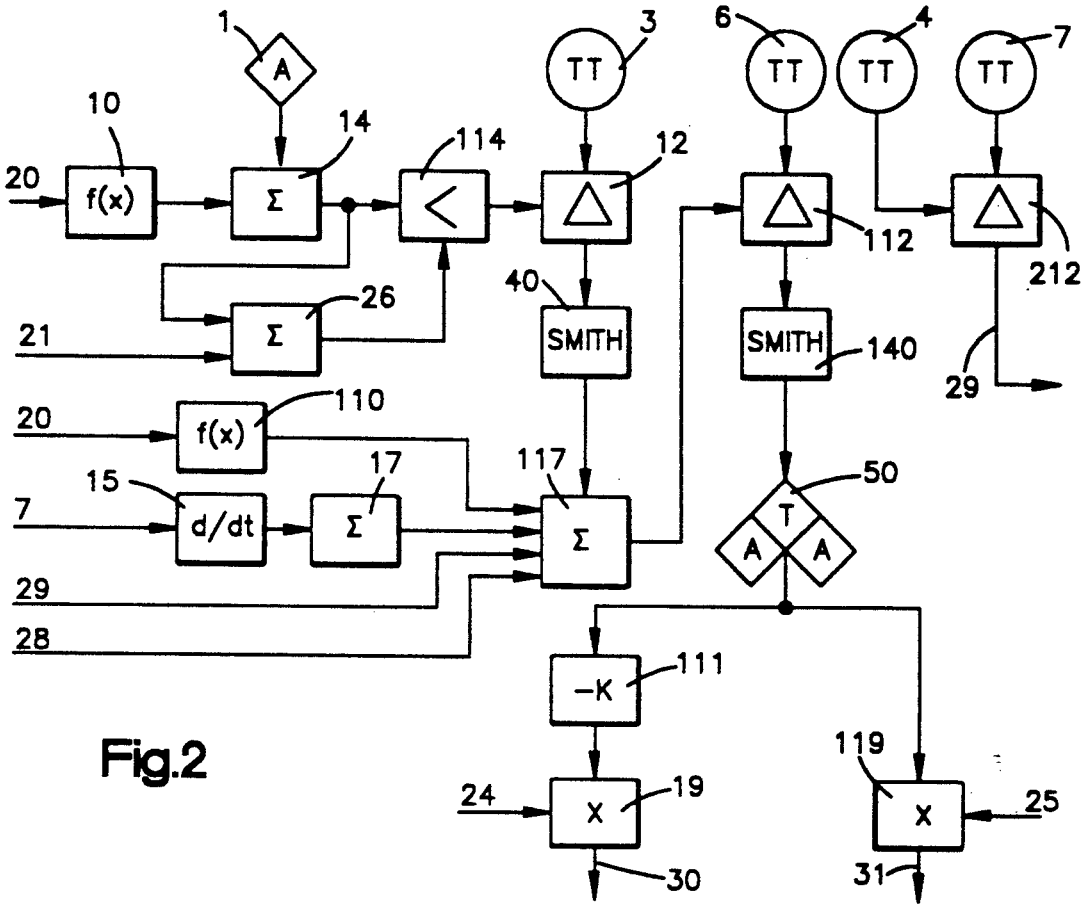
FIG. 2 is a schematic diagram of a control system according to the present invention.

The present invention embodied in FIG. 2 shows that the secondary superheater outlet temperature 3 comprises an outer and slower loop for the control system while a convection pass outlet temperature control 6 is used as an inner and faster loop. The cascaded steam temperature control loop of the present invention provides for a steam temperature set point 1 to be utilized for the system. Set point 1 from analog control station 50 can be set to bias programmed set point 10.

A low select auctioneer 114 selects either the set point 14 or the set point 26, whichever is less and provides this value to a difference unit 12. Primary superheater outlet temperature error 21 combined with set point 14 is used as an override signal in order to protect the secondary superheater outlet tubes of the boiler.

The secondary superheater outlet temperature transmitter 3 transmits its value to difference unit 12. The value from the difference unit 12 is passed to a first Smith Predictor function 40. As is well known to those skilled in the art, the Smith Predictor function performs a first order function to thereby provide predictive process control from an error signal developed from the process variable and set point inputs measured against an internal model of the process. The value from the Smith Predictor function 40 is provided to a summer unit 117.

The following characterized signals input to the summing unit 117 form a feedforward system:

Unit load demand 20 input to a function generator 110 which characterizes it as a function of temperature.

Secondary superheater inlet temperature input to derivative action unit 15, which output is gained by summer input 17.

The difference value of the primary superheater outlet temperature with the secondary superheater inlet temperature.

Gas recirculation fan damper position 28.

Output of the Smith Predictor function 140.

Differential action unit 112 receives the summation value 117 in addition to a convection pass outlet temperature 6 as another controlled variable. The difference determined by the differential action unit 112 is provided to a second Smith Predictor function 140. After the performance by the Smith Predictor function 140, this value is provided to the feedwater flow rate and firing rate analog control station 50.

After analog control station 50 receives an adjustment signal from Smith Predictor function 140, it controls both the firing rate 30 and the feed water flow rate 31. Analog control station 50 utilizes an inverter action unit 111 for determining directional action to a multiplier 19 for performing a multiplying action with fuel flow demand 24. The multiplying action performed by the multiplier 19 provides the firing rate 30 for this system.

A second multiplier 119 performs a multiplying action upon the value provided by the analog control station 50 and feedwater demand 25. The feedwater flow rate 31 is determined by the multiplying action of the multiplier 119.

Key aspects of the control system according to the present invention include set point generation, anticipatory signal generation, variable process limits, process modeling of the outer secondary superheater outlet temperature loop using a first order approximation, error correction/control action of the outer loop and the set point generation for the convection pass outlet temperature 6, process modeling of the inner loop or the convection pass outlet temperature 6 using a first order approximation and error correction/control action on the inner loop and final control output.

The secondary superheater outlet temperature set point 1 is generated as a function of the unit load demand 20 which characterizes the steam temperature profile for the universal pressure boiler. Set point 1 can be biased by an operator in order to provide better temperature matching during a load change or upset condition. The primary superheater outlet temperature error 21 is used as an overriding signal for the programmed set point 14. Accordingly, this circuit is used to protect the superheater tubes and prolong the turbine life.

The load versus convection pass feedforward signal is determined by performing a load ramp over the entire load spectrum of the universal pressure boiler. This load test determines natural characteristics of the convection pass outlet temperature 6.

Figure 3:
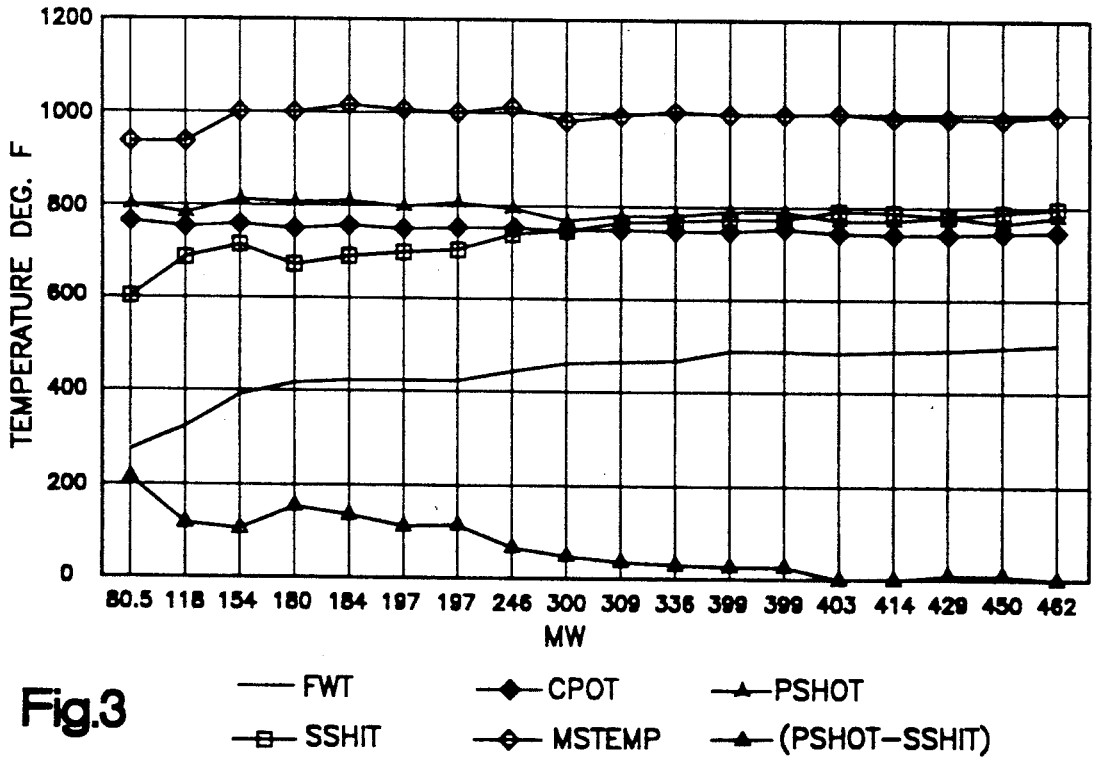
FIG. 3 is a chart plotting the temperature profile of the unit load of the present invention.

FIG. 3 illustrates the temperature profile of the universal pressure boiler at various unit loads. The difference 29 in the primary superheater outlet temperature 4 and the secondary superheater inlet temperature 7 illustrated by $\Delta T$ is used as an anticipatory feedforward signal. The primary superheater outlet temperature 4 and secondary superheater inlet temperature signal 7 correction depends on its sign and magnitude. For example, an increasing $\Delta T$ value reduces the convection pass outlet set point which in turn sets the secondary superheater outlet temperature within the control range. A decreasing $\Delta T$ value has the reverse effect. This signal predicts enthalpy fluctuations of the boiler and the forces that are used by the system for correcting these fluctuations.

FIG. 3 illustrates the temperature profile for the feedwater temperature, convection pass outlet temperature 6, primary superheater outlet temperature 4, secondary superheater inlet temperature 7, secondary superheater outlet steam temperature and the primary superheater outlet steam temperature and secondary superheater inlet temperature difference 26.

The secondary superheater inlet temperature 7 is used as a kicker in that fast derivative action is provided on the secondary superheater inlet temperature 7 in order to achieve immediate correction on load changes. An increasing high value for the secondary superheater inlet temperature 7 induces a negative correction and a decreasing value for the secondary superheater inlet temperature has an opposite effect.

The gas recirculation fan damper position 28 is used as an anticipatory feed forward signal in order to control the furnace heat absorption and the steam temperature. It is important to note that a change in the heat absorption pattern causes the secondary superheater outlet temperature, as one of the variables of the system, to be effected. Increasing the gas recirculation fan damper position 28 causes a decrease in the furnace heat absorption which in turn causes an increase in the convection pass outlet temperature 6, primary superheater outlet temperature 4 and the secondary superheater outlet temperature 3. In order to counteract this action, the convection pass outlet temperature 6 set point must be decreased as a function of an increase in the gas recirculation fan damper position 28 in order to help in maintaining the secondary superheater outlet temperature 3 within the operating range. Reverse action is necessary if there is an decrease in the gas recirculation fan damper position 28.

Variable process limits are utilized by the present invention in order to allow for a more flexible system for preventing anti-windup situations by varying the high and low limits of the controller based on feedforward signals.

Figure 5:
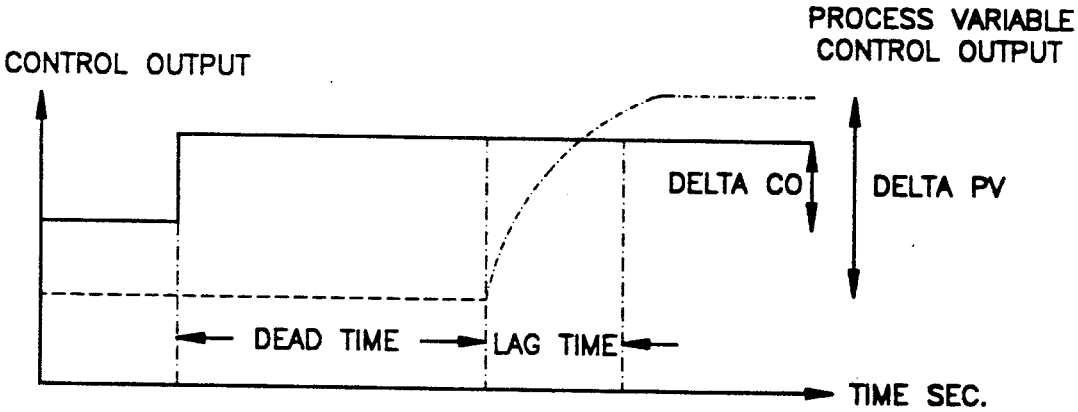
FIG. 5 is a chart diagramming a process model according to the present invention.

FIG. 5 illustrates a process model of the present invention using a first order approximation. In order to arrive at the model of FIG. 5, a load ramp is performed over the entire boiler range. A predetermined number of step changes, typically five or six, are induced for determining the following variables: process gain, dead time, lag time and time constant.

The process gain of the present invention is a change in the control output divided by the change in the process variable, i.e. the process gain is analogous to the sensitivity of the process. By way of example, the gas recirculation fan damper position 28 is introduced as an outside contributing factor which has a tremendous impact on the sensitivity of the process especially at low to medium ranges. Dead time for the present invention is the measure of the time needed for a change in the process variable to take effect after a change in the control output has occurred. Lag time is a measure of the time from the end of the process dead time to approximately 63% of the crest of the final process change (1 tau).

The time constant can provide either a derivative action or additional filtering or even lag time. A number equal to the lag time nullifies this function, while a number greater than the lag time provides additional lag time; and a number less than the lag time provides a derivative action.

The present invention provides for corrective action to be taken on the secondary superheater outlet temperature 3 by using a set point 14 that is generated by a model. Additionally, the present invention provides for control action of the convection pass temperature set point 6, wherethe secondary superheater outlet temperature generates the set point for the convection pass outlet temperature. Additional corrections are performed by the feedforward program.

Moreover, the present invention allows for process modeling of the inner loop or convection pass outlet temperature 6 using a first order approximation. The inner loop or convection pass outlet temperature loop 6 is more sensitive than the outer loop. The inner loop involves a smaller gain i.e. more sensitivity, and also utilizes dead time, lag time and a tuning time constant with derivative action similar to the process modeling of the outer loop as previously described.

The present invention allows for a controller to maintain the convection pass outlet temperature 6 at set point. The convection pass outlet temperature 6 must be maintained at its set point in order to control the secondary superheater outlet temperature 3. If the convection pass outlet temperature 6 is not maintained at its set point, the control of the secondary superheater outlet temperature 3 is virtually impossible.

FIG. 6 illustrates data gathered for a temperature profile for controlled variables of the present invention. The controlled variables include the unit load demand 20, feedwater temperature, convection pass outlet temperature 6, primary superheater outlet temperature 4, secondary superheater inlet temperature 7 and secondary superheater outlet temperature 3. Unit load demand 20 is in megawatts (mw) while the other controlled variables are in degrees fahrenheit (°F).

FIG. 6 shows that from a load range of 114.4 mw to 360.9 mw, temperatures are maintained well within control limits. A change in the unit load demand 20 from 157 mw to 170.75 mw provokes an increase of the secondary superheater inlet temperature 7 and the secondary superheater outlet temperature 3 and a counteracting move by the present invention which forces the convection pass outlet temperature 6 and the primary superheater outlet temperature 4 to decrease in order to bring the secondary superheater outlet temperature 3 to the set point 14.

During this change, the secondary superheater inlet temperature 7 is deviated by +10° F. to 660° F.; the secondary superheater outlet temperature 3 is deviated by +6° F. to 1,006° F.; the convection pass outlet temperature is deviated by 4° F. to 746° F.; and the primary superheater outlet temperature 4 is deviated by 2° F. to 828° F. The present invention allows for the secondary superheater outlet temperature 3 or the secondary superheater outlet temperature to remain within a +/−10° F. range during load changes.

The steam temperature control provided by the present invention is further illustrated by the graphs shown in FIGS. 7 and 8 of the trend in the secondary superheater inlet temperature (graphs 7*a* and 8*a*), the secondary superheater outlet temperature (graphs 7*b* and 8*b*), primary superheater outlet temperature (graphs 7*c* and 8*c*), the unit load demand (graphs 7*d* and 8*d*) and the convection pass outlet temperature (graphs 7*e* and 8*e*) when the unit load demand was changed as described above from 157 Mw to 170.75 Mw. It should be appreciated that the horizontal axis in FIGS. 7 and 8 represents time and that the graph in FIG. 8 which has the same letter as a graph in FIG. 7 is simply a continuation of that graph with time. Each trend graph starts at time T0 (see FIG. 7) and ends at time T6 (see FIG. 8). In order to provide continuity between the graphs shown in FIGS. 7 and 8, the graphs of FIG. 8 overlap the graphs of FIG. 7 for times T2, T3 and T4.

Figure 4:
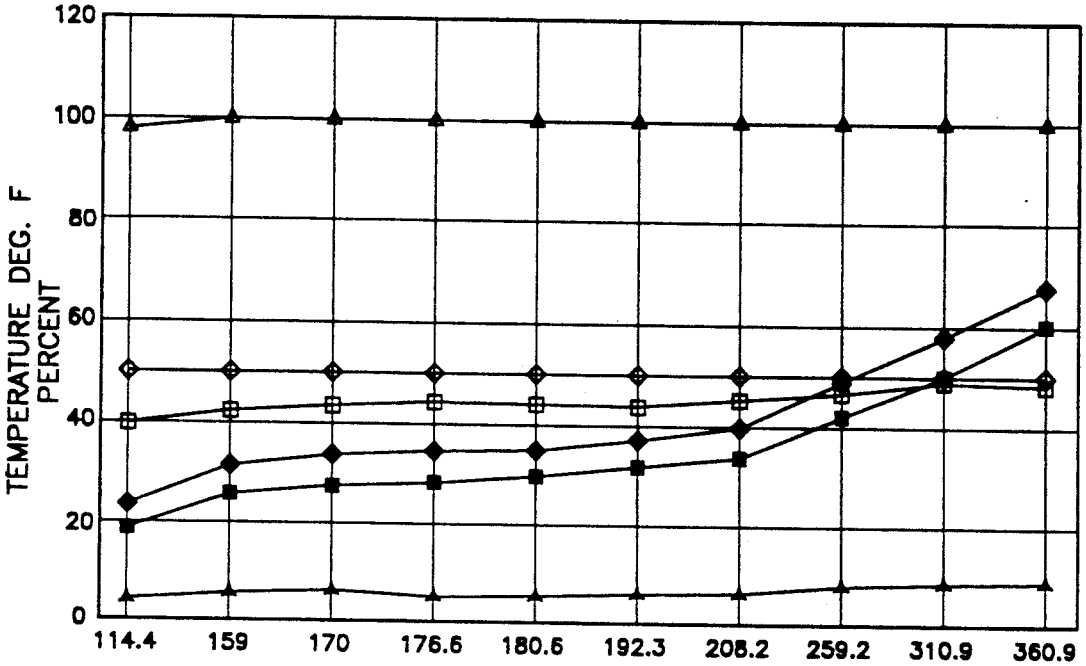
FIG. 4 is a chart plotting the feedwater and fuel ratio of the present invention.

FIG. 4 illustrates the feedwater and fuel flow ratio and their relationship with the secondary superheater outlet temperature.

The present invention provides for tight control of the steam temperature of the universal pressure boiler which is crucial for the plant operation and life of the equipment. Benefits provided by the present invention include an improvement of the unit heat rate; protection of the superheater tubes; prevention of thermal expansion and erosion of the turbine; control of temperature fluctuations; and application for variable pressure operation.

While a specific embodiment of the invention has been shown and described in detail to illustrate the application of the principles of the invention, it will be understood that the invention may be embodied otherwise without departing from such principles.

What is claimed is:

1. A system for controlling steam temperature of a universal pressure boiler, said boiler including means for measuring temperature at a primary superheater outlet, a secondary superheater inlet, a secondary superheater outlet and a convection pass outlet of said boiler and for measuring a unit load demand of said boiler, said system comprising:

means for providing a signal indicative of a difference between said measured primary superheater outlet temperature and said measured secondary superheater inlet temperature;

means responsive to said measured unit load demand of said boiler for deriving a setpoint for said secondary superheater outlet temperature;

means for providing a first Smith Predictor function for the difference between said derived setpoint for said secondary superheater outlet temperature and said measured secondary superheater outlet temperature;

means responsive to said first Smith Predictor function, said unit load demand, said temperature difference signal and said measured secondary superheater inlet temperature for deriving a setpoint for said convection pass outlet temperature;

means for providing a second Smith Predictor function for the difference between said derived setpoint for said convection pass outlet temperature and said measured convection pass outlet temperature; and means responsive to said second Smith Predictor function for providing a signal for controlling a firing rate and a feedwater flow rate of said boiler to thereby control said boiler steam temperature.

2. The system of claim 1 wherein said boiler includes means for measuring a fan damper position for said boiler and said means responsive to said first Smith Predictor function, said unit load demand, said temperature difference signal and said measured secondary superheater inlet temperature is also responsive to said measured fan damper position.

3. A method for controlling steam temperature of a universal pressure boiler, said boiler including means for measuring temperature at a primary superheater outlet, a secondary superheater inlet, a secondary superheater outlet and a convection pass outlet of said boiler and for measuring a unit load demand of said boiler, said method comprising the steps of:

providing a signal indicative of a difference between said measured primary superheater outlet temperature and said measured secondary superheater inlet temperature;

deriving in response to said measured unit load demand of said boiler a setpoint for said secondary superheater outlet temperature;

providing a first Smith Predictor function for the difference between said derived setpoint for said secondary superheater outlet temperature and said measured secondary superheater outlet temperature;

deriving in response to said first Smith Predictor function, said unit load demand, said temperature difference signal and said measured secondary superheater inlet temperature a setpoint for said convection pass outlet temperature;

providing a second Smith Predictor function for the difference between said derived setpoint for said convection pass outlet temperature and said measured convection pass outlet temperature; and providing in response to said second Smith Predictor function a signal for controlling a firing rate and a feedwater flow rate of said boiler to thereby control said boiler temperature.

4. The method of claim 3 wherein said boiler includes means for measuring a fan damper position for said boiler and said step of deriving in response to said first Smith Predictor function, said unit load demand, said temperature difference signal and said measured secondary superheater inlet temperature a setpoint for said convection pass outlet temperature is also responsive to said measured fan damper position.

* * * * *